US011211737B2

(12) United States Patent
Pacher et al.

(10) Patent No.: US 11,211,737 B2
(45) Date of Patent: Dec. 28, 2021

(54) NETWORK CONNECTOR MODULE FOR A NETWORK CONNECTOR

(71) Applicant: APTIV TECHNOLOGIES LIMITED, St. Michael (BB)

(72) Inventors: Franz Pacher, Roth (DE); Reinhard Hinteregger, Bad Kleinkirchheim (AT); Yuhan Chen, Wuppertal (DE)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/839,326

(22) Filed: Apr. 3, 2020

(65) Prior Publication Data

US 2020/0328553 A1 Oct. 15, 2020

(30) Foreign Application Priority Data

Apr. 11, 2019 (EP) ..... 19168567

(51) Int. Cl.
*H01R 13/514* (2006.01)
*H01R 13/115* (2006.01)
(Continued)

(52) U.S. Cl.
CPC ..... *H01R 13/514* (2013.01); *H01R 13/115* (2013.01); *H01R 13/506* (2013.01); *H01R 13/6593* (2013.01)

(58) Field of Classification Search
None
See application file for complete search history.

(56) References Cited

U.S. PATENT DOCUMENTS 5,632,634 A * 5/1997 Soes ..... H01R 24/40 439/101
7,731,528 B2 * 6/2010 Feldman ..... H01R 13/6592 439/578
(Continued)

FOREIGN PATENT DOCUMENTS

WO 03/084003 A1 10/2003
WO 2011/058501 A1 5/2011
WO 2011/094656 A2 8/2011

OTHER PUBLICATIONS

Extended European Search Report for Application No. EP 19 16 8567 dated Jan. 10, 2019.
(Continued)

*Primary Examiner* — Oscar C Jimenez
(74) *Attorney, Agent, or Firm* — Carlson, Gaskey & Olds, P.C.

(57) ABSTRACT

An illustrative example embodiment of a network connector module for a network connector is adapted for network communication with data rates of at least up to 1 Gbit/s. The network connector module comprises a module housing of electrically insulating material wherein the module housing comprises at least two terminal receptacles that are arranged directly adjacent to each other, each of the terminal receptacles receives an electrical contact terminal. The network connector module comprises further an electrical shielding member made of cut and bent sheet metal, wherein the electrical shielding member at least partially surrounds the module housing. The electrical shielding member includes at least two contact elements for electrically contacting ground contacts of a corresponding counter connector. The contact elements are arranged lateral of the module housing, so as to be in a row with the electrical contact terminals. Further, the contact elements sandwich the electrical contact terminals.

16 Claims, 9 Drawing Sheets

(51) Int. Cl.
*H01R 13/506* (2006.01)
*H01R 13/6593* (2011.01)

(56) References Cited

U.S. PATENT DOCUMENTS

| | | | | |
|---|---|---|---|---|
| 7,744,414 | B2 * | 6/2010 | Scherer | H01R 13/518 439/607.05 |
| 10,790,617 | B2 * | 9/2020 | Takahashi | H01R 13/6593 |
| 2013/0309221 | A1 | 12/2012 | Scherer et al. | |
| 2018/0034175 | A1 * | 2/2018 | Lloyd | H01R 12/71 |
| 2019/0245288 | A1 | 8/2019 | Lloyd et al. | |
| 2019/0319389 | A1 * | 10/2019 | Hara | H01R 13/426 |

OTHER PUBLICATIONS

Chinese Office Action for Chinese Patent Application No. 202010279895.2 dated Jun. 3, 2021.

* cited by examiner

NETWORK CONNECTOR MODULE FOR A NETWORK CONNECTOR

CROSS-REFERENCE TO RELATED APPLICATIONS

This application claims priority to European Patent Application No. 19168567.6, filed on Apr. 11, 2019.

FIELD OF THE INVENTION

The invention relates to a network connector module for a network connector, to a network connector assembly as well as to a method to assemble the network connector module and to a method to assemble the network connector. Example embodiments of the network connector are suitable for network communication at data rates of at least up to 1 Gbit/s. Further the network connector may be used in automotive applications.

BACKGROUND

Network connectors capable of network communication at data rates of at least 1 Gbit/s may be used in automotive applications, such as vehicles. In recent years, vehicles have been equipped with numerous on-board electronics. These on-board electronics provide a wide field of functionality, such as sensors, control functions and the like. These on-board electronics provide typical consumer electronic functions, navigation control and/or safety features, as well as e.g. feedback control for autonomous driving. For data communication between single on-board electronic components, data networks have been established within vehicles. These data networks communicate at high data rates, to allow for a safe and reliable communication. Typically, data networks are based on Ethernet networks, operating at data rates up 1 Gbit/s.

To achieve high data rates, specific network communication connectors (data connectors) are used. These specific data connectors come along with a specific plug interface, typically including shielding sheet metal elements. The specific plug interface and shielding sheet metal elements are necessary to reduce cross talk. Typically, those specific plug interfaces cannot easily be combined with known standardized interfaces. Standardized interfaces typically provide ground- and signal contacts in a defined pattern, such as a line and row pattern. Within a line or row, adjacent contacts (ground-and/or signal contacts) may have a defined pitch s of about 1.5 mm, 1.8 mm or 2.0 mm Those standardized interfaces are not suited for network communication at data rates of at least up to 1 Gbit/s but are generally used for signal transmission of digital I/O-signals or for network communication at data rates of at most 100 Mbit/s.

Generally, the higher the data rate, the higher is the cross-talk level between single branches of the network, particularly if electrical contacts, connectors and/or cables of these branches are arranged adjacent and substantially parallel to each other. This is typically the case, if a cable harness is used for wiring the vehicle. Further, the cross-talk level is higher, the closer the single branches of the network are adjacent to each other. As standardized interfaces, have a very low row-pitch and/or line-pitch, these standardized interfaces are prone to high cross talk levels, when being used for the high data rate communication.

Further, with increased data rates, the EMC properties (electro magnetic compatibility) of connectors decreases. Thus, different connectors are provided for 1 Gbit/s networks. To overcome increased cross-talk levels and reduced EMC properties at data rates up to 1 Gbit/s, electrical shielding members are typically provided in a housing of known specific network connector or the network connector system, to prevent radiation from entering and/or leaving the connector housing. Said electrical shielding members typically entirely surround the connector housing, thereby providing good shielding performance. However, such electrical shielding members cause additional manufacturing costs and cannot be simply introduced in known standardized connectors.

SUMMARY

An illustrative example embodiment of a network connector module for a network connector is adapted for network communication with data rates of at least up to 1 Gbit/s. The single module as well as a network connector, comprising at least one network connector module is adapted for network communication with data rates of at least up to 1 Gbit/s. The network connector module is adapted to be received within a network connector module receptacle, such as a cavity, of the network connector. The network connector is adapted to be coupled to a corresponding counter connector, for network communication.

The network connector module comprises a shielded cable, wherein the cable includes at least two wires. The wires are adapted for transmitting data for network communication. The network connector module further comprises at least two electrical contact terminals for electrically contacting data contacts of a corresponding counter connector, wherein each of the electrical contact terminals is electrically connected to a respective one of the wires of the cable. Accordingly, the electrical contact terminals of the network connector module are adapted for transmitting data for network communication.

The network connector module further comprises a module housing of electrically insulating material. The electrically insulating material may include plastic material, such as a thermoplastic material or a thermosetting material, a ceramic material, or the like. Particularly, the module housing may be formed by injection molding.

The module housing comprises at least two terminal receptacles that are arranged directly adjacent to each other, each of the terminal receptacles receives one of the electrical contact terminals. Providing the terminal receptacles, respectively the electrical contact terminals adjacent to each other, allows to communicate using differential signal pairs, wherein the adjacent electrical contact terminals may form a differential signal pair.

The network connector module further comprises an electrical shielding member made of cut and bent sheet metal. The electrical shielding member allows to provide network communication with network connector module at data rates of at least up to 1 Gbit/s. The network connector module may have an impedance Zd in the range of 95 to 105Ω. Further, the network connector module may have a return loss RL of less than −30 dB (preferably less than −50 dB) at frequencies of less than 200 MHz and a return loss RL of less than −20 dB (preferably less than −30 dB) at frequencies in the range of 200 MHz to 600 MHz. Further, the network connector module may have a insertion loss IL of less than −0.1 dB at frequencies of less than 600 MHz.

The electrical shielding member is in electrical contact with a shielding of the cable, and the electrical shielding member at least partially surrounds the module housing. The electrical shielding member includes at least two contact elements for electrically contacting ground contacts of a corresponding counter connector. The contact elements are arranged lateral of the module housing, so as to be in a row with the electrical contact terminals received in the module housing. Further, the contact elements sandwich the electrical contact terminals. Accordingly, the contact elements and contact terminals are adapted to contact respective ground contacts (G) and data contacts (S) of a corresponding counter connector, wherein the ground contacts (G) and data contacts (S) are arranged in at least one row, having the following repeating contact pattern: GSSG. Multiple GSSG contact patterns may be arranged in a row of the interface, resulting in a repeating . . . GSSGGSSG . . . contact arrangement within one row. Alternatively, adjacent GSSG contact patterns can share a common ground contact, resulting in a repeating . . . GSSGSSG . . . contact arrangement within one row.

Arranging the contact elements and the electrical contact terminals in a row, as described above, allows to contact a corresponding counter connector, that has a standardized interface. The pitch between two adjacent contacts (ground- and/or signal contacts) may be about 1.5 mm, 1.8 mm or 2.0 mm Other pitches may be used instead. Thus, the network connector module can be used or inserted into known connectors, thereby providing high data rates with known connectors.

The electrical shielding member may comprise a receiving portion for receiving the module housing, wherein the contact elements protrude inwardly in receiving portion, so that, when the network connector module (respectively the network connector) is coupled to a corresponding counter connector, the contacting ground contacts and the data contacts of a corresponding counter connector are at least partly received in the receiving portion of the module housing. Inwardly protruding contact elements allow to provide a reliable electrical shielding member, as the shielding member protects the contact elements from getting damaged. Further, as the receiving portion of the electrical shielding member at least partially receives the ground contacts and data contacts of a corresponding counter connector, the shielding properties can be improved. Thus, less crosstalk occurs. A network connector module comprising inwardly protruding contact elements is adapted to contact respective ground contacts (G) and data contacts (S) of a corresponding counter connector having a . . . GSSGGSSG . . . contact pattern.

Further, the contact elements may protrude outwardly from the receiving portion, so that, when the network connector module is coupled to a corresponding counter connector, the contacting ground contacts are not received within the receiving portion of the module housing and the data contacts of a corresponding counter connector are at least partly received in the receiving portion of the module housing. A network connector module comprising outwardly protruding contact elements is adapted to contact respective ground contacts (G) and data contacts (S) of a corresponding counter connector having a . . . GSSGGSSG . . . contact arrangement or having a . . . GSSGSSG . . . contact arrangement.

The electrical shielding member may have a substantially rectangular cross section, having an inner height, measured from a bottom wall to a top wall of the electrical shielding member in the range of 2.5 mm to 3.3 mm, preferably in the range of 2.9 mm to 3.2 mm, and most preferably of about 3.1 mm With providing a height as described above, an air gap can be included in the receiving portion. This air gap allows to provide an impedance Zd in the range of 95 to 105 Ohms. Further, with said inner height a small module can be provided that can be used in known connectors. Preferably, the width of the shielding member, i.e. the width from a sidewall to a sidewall (measured outwardly), is in the range of 5.8 to 6.3 mm, preferably in the range of 5.9 to 6.2 mm and most preferably about 6.1 mm Thus, size can be further reduced, while impedance requirements are met, and high network communication data rates can be achieved.

The electrical shielding member may comprise a receiving portion for receiving the module housing, wherein the receiving portion is substantially U-shaped, and wherein the contact elements protrude outwardly from the receiving portion, so that when the network connector module (respectively the network connector) is coupled to a corresponding counter connector, the contacting ground contacts are not received in the receiving portion of the module housing. Outwardly protruding contact elements allow to further reduce the size of the shielding member, and accordingly of the network connector module. In particular, the width of the network connector module can be further reduced, while still providing data communication rates of at least up to 1 Gbit/s. The receiving portion has a U-shape seen in the direction against the mating direction A of the network connector module. Accordingly, the receiving portion at least partially surrounds the module housing on a bottom side and (at least partially) on two sidewalls thereof. This allows for reduced crosstalk and improved shielding properties.

The contact elements may be embossed elements, that can be integrally formed with a respective side wall of the receiving portion. Providing embossed contact elements allows to reduce manufacturing costs. In particular, the embossed elements can be provided as contact arms having a free end. Further, the embossed elements can be provided as contact protrusions that are connected to the sidewall on at least two ends of the respective embossed element. Free arms are more flexible and therefore allow to contact a ground or data contact, having a greater tolerance, wherein contact protrusions are more reliable and allow for higher contact forces.

The contact elements can be contact arms, that have a free end, wherein the free end may face in the mating direction A. Providing a contact arm with a free end that faces in the mating direction A leads to a shielding member design that is easy to manufacture and has reduces material consumption. The contact elements and in particular the contact arms may be provided at a front portion of the network connector module (i.e. adjacent to an end of the network connector module facing in mating direction A). In particular, the contact elements of the electrical shielding member may be arranged respective to the contact terminals of the network connector module so that upon coupling the network connector module (or the respective network connector) with a corresponding counter connector, the contact elements electrically contact the ground contact of the corresponding counter connector before the contact terminals electrically contact the data contact of the corresponding counter connector. Therefore, shielding is achieved before network communication can start. Thus, distortion (e.g. due to crosstalk) of adjacent network branches can be prevented or at least reduced.

The electrical shielding member may comprise at least one locking element that is adapted to engage with a corresponding locking element of the module housing for locking the module housing with the electrical shielding member. By locking the locking element of the electrical shielding member with the corresponding locking element of the module housing allows to lock the module housing and the electrical shielding member securely with each other. Thus, it can be prevented that the module housing and the electrical shielding member are separated from each other during use. Further, the locking element and the corresponding locking element allow for an easy manufacturing of the module and therefore to reduced manufacturing costs.

The at least one locking element may be a latching arm that can be provided on rearward portion of the electrical shielding member. Particularly, the at least one locking element may be provided at a bottom wall of the electrical shielding member. Providing the locking element on the rearward portion of the electrical shielding member allows to insert the module housing in the receiving portion of the electrical shielding member without being disturbed by the locking element. This is, as the module housing and the locking element come into engagement only, if the module housing is (almost) completely inserted into the receiving portion. Thus, the assembly of the network connector module is facilitated. Further, the locking element may provide a haptic feedback for the user, who assembles the network connector module. Thus, the correct locking can be sensed, and an incorrect assembly of the connector module can be prevented.

At least one locking element may be a through opening provided in a side wall of the receiving portion of the electrical shielding member. Through openings are easy to manufacture and therefore allow for further cost reduction of the shielding member. In particular, the locking elements provided as through openings can be locked with corresponding locking protrusions provided at the module housing.

The shielding member may be provided with different locking elements for providing a reliable locking with the module housing. In case of through openings, there may be at least two through opening on each sidewall of the receiving portion. Further, there may be at least two latching arms on a rearward portion of the electrical shielding member. Further, through openings and latching arms can be present at a shielding member for providing a secure locking. Other locking elements may also be used.

The electrical shielding member and/or the module housing includes a latching element for latching with a network connector. This allows for a reliable and preferably tool-less assembly of the module within the network connector. The latching elements may be provided in form of a latching arm or a latching recess that latches with a corresponding latching element of the network connector. Further, multiple latching elements may be provided wherein the latching elements may have different forms.

The electrical shielding member may comprise at least one guiding shoulder, for linearly guiding the module housing during the insertion of the module housing in the receiving portion. The guiding shoulder may be formed by a stepped portion in the top wall of the receiving portion of the electrical shielding member. Further, the top wall of the receiving portion may at least be partially cutout so as to receive the module housing. The guiding shoulders facilitate the manufacturing and assembly of the network connector module and at the same time may serve to guide the network connector module when the network connector module is inserted in a network connector module receptacle network connector. Thus, no additional guiding surfaces need to be provided and a small network connector module can be achieved.

The contact elements and the electrical contact terminals may be arranged so as to be adapted to electrically contact ground contacts and data contacts of a corresponding counter connector that have an equidistant pitch in row direction, wherein the pitch may be about 1.5 mm, 1.8 mm or 2.0 mm Other pitches may be used instead. Thus, the network connector module may be used with standardized interfaces.

The object is further at least partly achieved by a network connector assembly that is capable of communicating at data rates of at least up to 1 Gbit/s, wherein the network connector assembly comprises a network connector housing, and at least two network connector modules, as described above. In particular, the network connector housing may be a housing of a network connector that has a standardized interface, having a row pitch of 1.5 mm, 1.8 mm or 2.0 mm Other pitches may be used instead.

The network connector housing comprises network connector module receptacles, for receiving the at least two network connector modules. Those module receptacles may be spaced apart from each other (in row direction) of about 4 times the pitch, i.e. of about 6 mm (4×1.5 mm), or of about 7.2 mm (4×1.8 mm) or of about 8 mm (4×2 mm), in case a . . . GSSGGSSG . . . contact arrangement is used, depending on the row pitch used. The contact elements and contact terminals may be adapted to contact respective ground contacts (G) and data contacts (S) of a corresponding counter connector, wherein the ground contacts (G) and data contacts (S) are arranged in at least one row, having the following repeating contact arrangement . . . GSSGG SSG . . . .

In case adjacent GSSG contact patterns share a common ground contact, i.e. in case a . . . GSSGSSG . . . contact arrangement us used, module receptacles may be spaced apart from each other (in row direction) of about 3 times the pitch, i.e. of about of about 4.5 mm (3×1.5 mm), or of about 5.4 mm (4×1.8 mm) or of about 6 mm (4×2 mm).

The network connector housing may comprise single row or multiple rows of network connector module receptacles, wherein each row may comprise at least two, preferably at least 4 and most preferably at least 8 of network connector module receptacles. Accordingly, the network connector assembly may comprise a single row or multiple rows of network connector modules, wherein each row may comprise at least two, preferably at least 4 and most preferably at least 8 of network connector modules.

The network connector assembly may further comprise at least two network connector module seals that are received in the network connector module receptacles and a seal retaining member that is adapted to be coupled to the network connector housing and to retain the network connector modules and the network connector module seals within the network connector module receptacles. Thus, a sealed network connector can be provided.

An illustrative example embodiment of a method for assembling a network connector module as described above includes inserting the module housing in the receiving portion of the electrical shielding member, and locking the module housing with the electrical shielding member. This allows for a reliable assembly, while saving costs.

An illustrative example embodiment of a method for assembling a network connector assembly as described above includes providing at least two network connector modules, providing the network connector housing, inserting each network connector module in a respective network connector module receptacle of the network connector housing, and latching the network connector module with the network connector housing. This allows for a reliable assembly, while saving costs.

BRIEF DESCRIPTION OF THE DRAWINGS

In the following, preferred embodiments of the invention are described in relation to the accompanied figures, wherein.

DETAILED DESCRIPTION

Figure 1A:
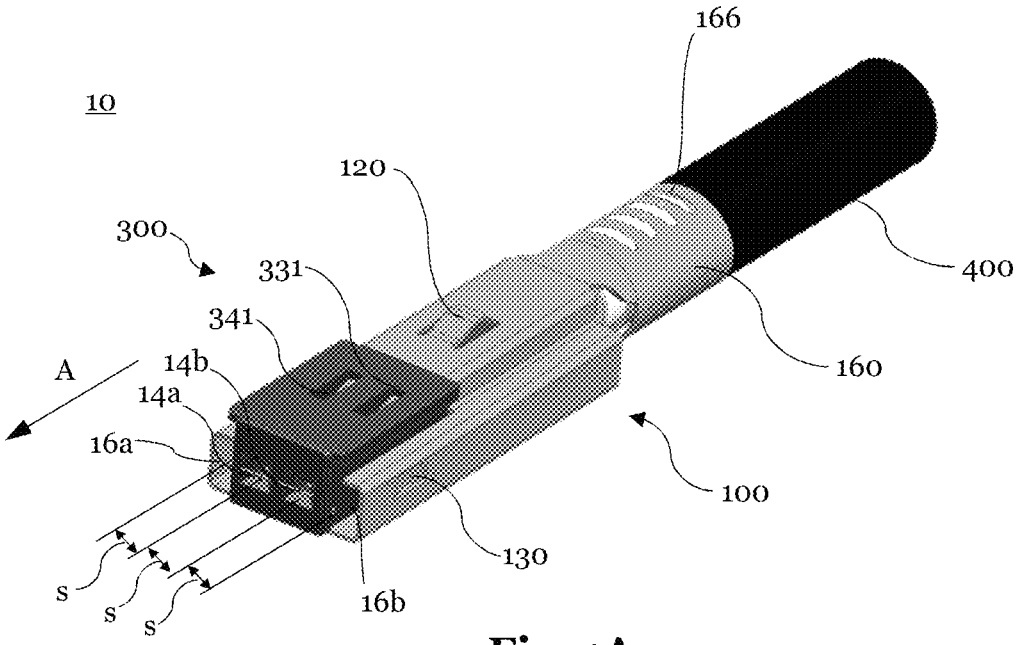
FIG. 1A is a schematic perspective view of a network connector module, according to a first embodiment.

FIG. 1A is a schematic perspective view of a network connector module 10 according to a first embodiment. The network connector module 10 is adapted for network communication with data rates of at least up to 1 Gbit/s. The network connector module 10 comprises a shielded cable 400 that may be held in the electrical shielding member 100 by means of a cable reception 160. Cable reception 160 may be provided with retaining protrusions 166 that protrude inwardly in the substantially cylindrical portion of the cable reception 160, thereby increasing the retention force of the cable 400 from the electrical shielding member 100.

The electrical shielding member 100 comprises a receiving portion 110 for receiving a module housing 300. Further, the electrical shielding member 100 may comprise a latching element 120 for latching the network connector module 10 with a network connector (not shown). Further, the electrical shielding member may at least partially surround the module housing 300 on a bottom side 116 and at least partially on two sides, i.e. at sidewalls 118, 119.

The electrical shielding member includes at least two contact elements 130, 140 for electrically contacting ground contacts of a corresponding counter connector (not shown). The contact elements 130, 140 may be provided in respective sidewalls 118, 119 of the receiving portion 110 of the electrical shielding member 100.

The network connector module 10 may comprises data pin receptacles 14*a*, 14*b* and ground pin receptacles 16*a*, 16*b*. Those receptacles are arranged in a row wherein the contact elements of the electrical shielding member are adapted for electrically contacting ground contacts (ground pins) of a corresponding counter connector and the contact terminals (not shown) are arranged for contacting data contacts (signal pins). As the contact elements sandwich the electrical contact terminals, the contact elements 130, 140 and the contact terminals are adapted to contact respective ground contacts and data contacts of a corresponding counter connector (not shown), wherein the ground contacts and the data contacts are arranged in at least one row having a repeating contact pattern of ground contact-data contact-data contact-ground contact (GSSG). Multiple GSSG contact patterns may be arranged in a row of the interface, resulting in a repeating . . . GSSGGSSG . . . contact arrangement within one row (cf. FIG. 5A).

Figure 3:
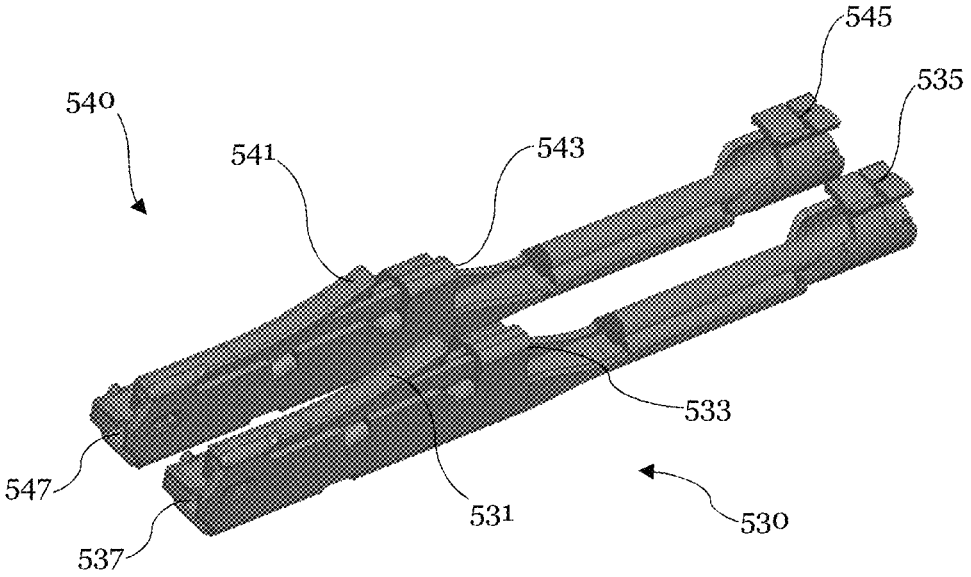
FIG. 3 is a schematic perspective view of electric contact terminals of a network connector module.

The ground pin receptacle and signal pin receptacle may have a pitch s, wherein the pitch s may be about 1.5 mm, or about 1.8 mm, or about 2.0 mm Other pitches may be used instead. Further, the module housing may have corresponding locking elements 331, 341 that are adapted to be locked with primary locking means 531, 541 of electrical contact terminals 530, 540, as shown in FIG. 3. Those corresponding locking elements 331, 341 may be provided as locking appertures.

Figure 1B:
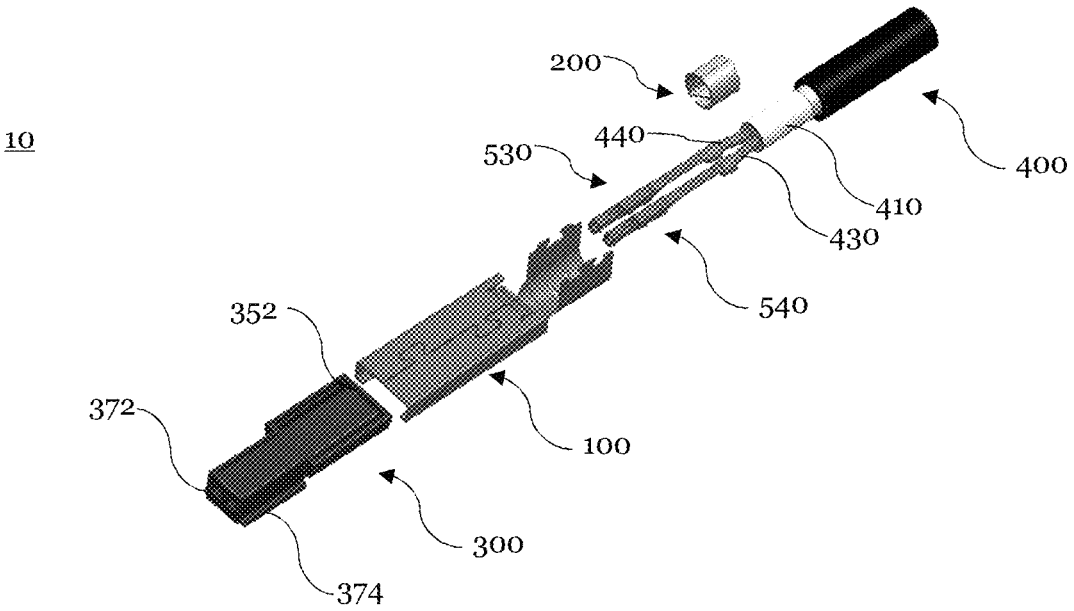
FIG. 1B is a schematic exploded view of the network connector module, as shown in FIG. 1A.

FIG. 1B is a schematic exploded view of the network connector module as shown in FIG. 1A. As shown, cable 400 may be a shielded cable that comprises an electrical shield 410 and two wires 430, 440 for transmitting network communication data. The wires 430, 440 may be electrically connected to respective contact terminals 530, 540. These contact terminals 530, 540 may be received within the module housing 300. The module housing 300 is received within a receiving portion 110 of the electrical shielding member 100.

The shield 410 of the cable 400 can be folded back and can be secured by means of an inner ferrule 200. The inner ferrule 200 forms a sleeve that is formed from cut and bent sheet metal and may surround the cable 400 at least partially. Then, the cable reception 160 can be crimped over the ferrule 200, thereby securing the cable 400 and the ferrule 200 within the electrical shielding member 100.

Figure 1C:
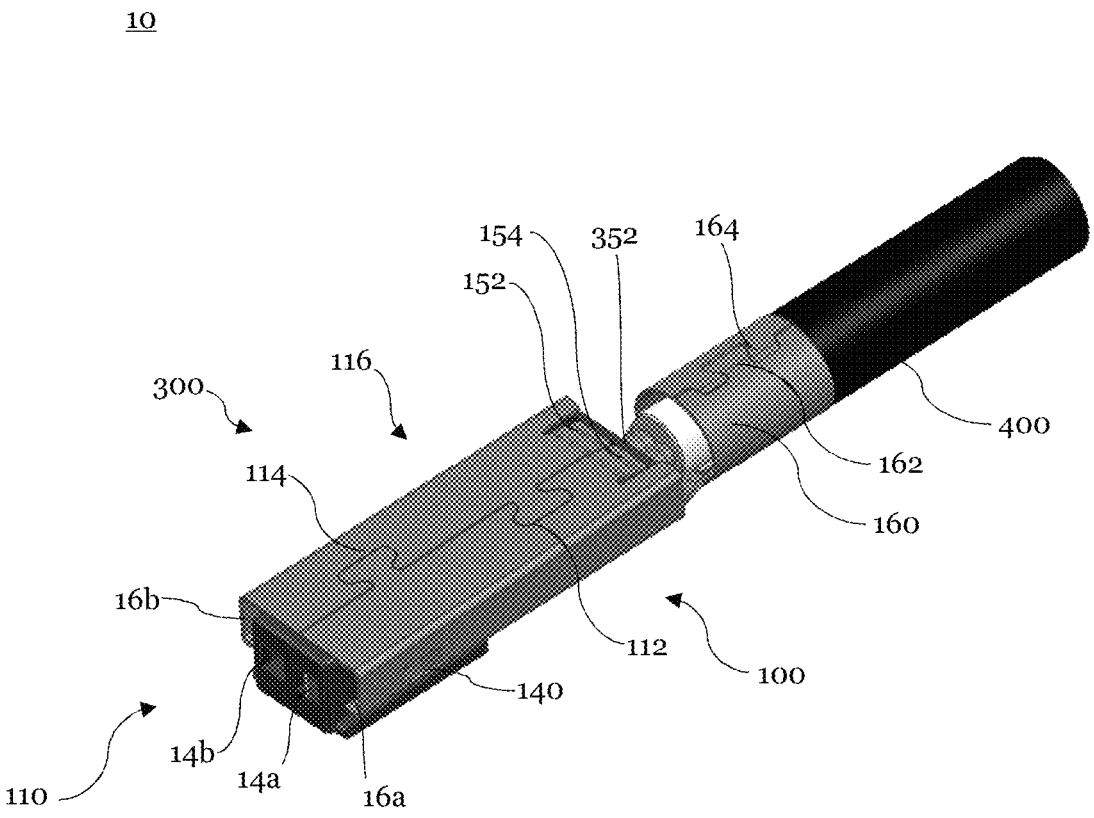
FIG. 1C is further a schematic perspective view of a network connector module, as shown in FIG. 1A.

FIG. 1C shows a schematic perspective view of the network connector module 10, as described above. In particular, FIG. 1C provides a bottom view of the network connector module 10. As shown, bottom wall 116 may be a divided wall. In particular, bottom wall 116 can be assembled by two bottom wall parts, each having a contoured locking edge 112, 114 that engage with each other. The contoured locking edges 112, 114 may comprise a puzzle shape form.

On a rearward portion of the electrical shielding member 100, preferably on a bottom wall 116, locking elements 152, 154 may be provided which lock with a corresponding locking element 352 of the module housing 300. Thus, the module housing 300 can be secured (locked) in the electrical shielding member 100. The cable reception 160 may also be assembled (joint) by respective contoured edges 162, 164 that may comprise a puzzle shape form. The contoured locking edges of the divided bottom wall and the cable reception allow for a stable and reliable connection of the edges. Further, the electrical shielding member 100 may be formed from a single piece of sheet metal. Thereby providing a low-priced shielding member.

Figure 2A:
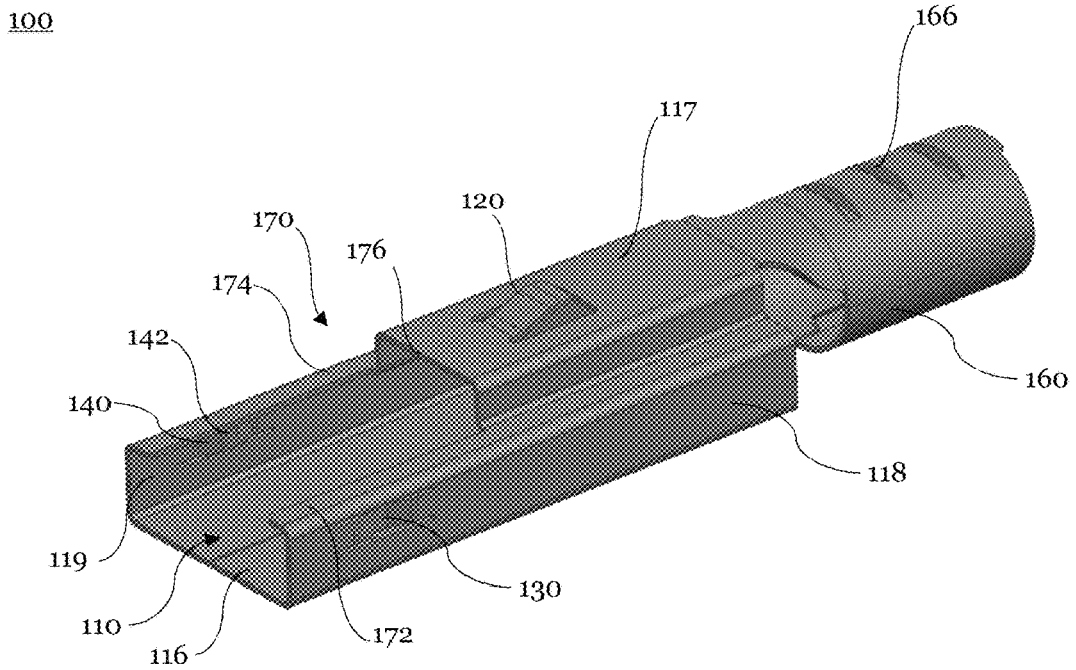
FIG. 2A is a schematic perspective view of an electrical shielding member of a network connector module.

FIG. 2A shows a schematic perspective view of an electrical shielding member 100 for a network connector module 10. The electrical shielding member 100 has a substantially rectangular cross section, when seen from a direction against the mating direction A. The rectangular cross section is formed by a bottom wall 116 and a top wall 117 as well as by two sidewalls 118, 119. The top wall 117 may have a stepped portion that forms guiding shoulders 172, 174. These guiding shoulders 172, 174 serve for guiding the module housing (respectively corresponding guiding shoulders 372, 374) during inserting the module housing 300 in the receiving portion 110 of the electrical shielding member 100. The top wall 117 may comprise a cutout portion 170 for receiving the module housing 300. This cutout portion 170 may have a rearward abutment face 176 for abutting the module housing 300 and thereby limiting the insertion depth of the module housing 300 in the electrical shielding member 100. The contact elements 130, 140 are provided in the shown embodiment laterally at sidewalls 118, 119, and protrude inwardly in the receiving portion 110. The contact elements 130, 140 may be provided as embossed elements that are connected with the sidewall on at least two sides thereof. Further, each contact element 130, 140 may be provided with at least one contact face 132, 142 which is adapted to electrically contact a respective ground contact of a corresponding counter connector.

Figure 2B:
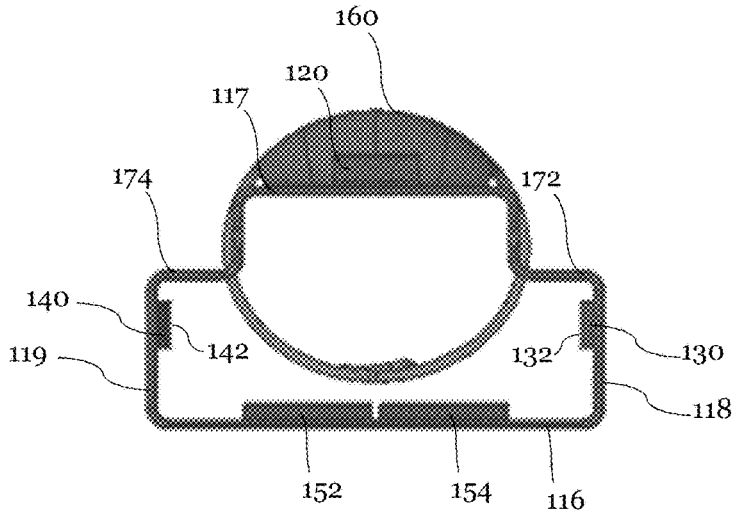
FIG. 2B is a schematic front view of an electrical shielding member of a network connector module.

FIG. 2B shows a schematic perspective front view of the electrical shielding member seen in a direction against the mating direction A. The contact elements 130, 140 may protrude inwardly in the receiving portion 110. Further, each of the contact elements 130, 140 may be provided with at least one contact face 132, 142. Further, locking elements 152, 154 may protrude inwardly in the receiving portion and thus may be adapted for locking the module housing 300 when it is received in the shielding member 100.

FIG. 3 is a schematic perspective view of electric contact terminals 530, 540 of a network connector module 10, 10', 10". The electrical contact terminal 530, 540 may have a primary locking element 531, 541 and the module housing may have a corresponding primary locking element 331, 341, that engage with each other when the terminal 530, 540 is assembled. Further, the electrical contact terminal 530, 540 may have a secondary locking element 533, 543 and the connector housing may have a corresponding secondary locking element (not shown), that engage with each other when the terminal is assembled.

The primary locking element 531, 541, the corresponding primary locking element 331, 341, the secondary locking elements 533, 543, the corresponding secondary locking elements may be arranged so that, when pulling the cable 400 out of the connector module 10, 10', firstly the primary locking elements 531, 541 and the corresponding primary locking elements 331, 341 abut each other. Subsequently, the secondary locking elements 533, 543 and the corresponding secondary locking elements may abut each other. Thus, the cable 400 can be held reliable with in the network connector module, without losing its electrical connection.

The primary locking elements 531, 541 of the electrical contact terminals 530, 540 may be provided as latching arms and the secondary locking elements 533, 543 may be provided as locking recess that receive a corresponding secondary locking element.

The terminals 530, 540 may be provided with crimping means 535, 545 for electrically contacting the wires 430, 440 of the cable 400. Further, each terminal 530, 540 comprises a contact pin receptacle for receiving and electrically contacting a respective data contact or signal pin.

Figure 4A:
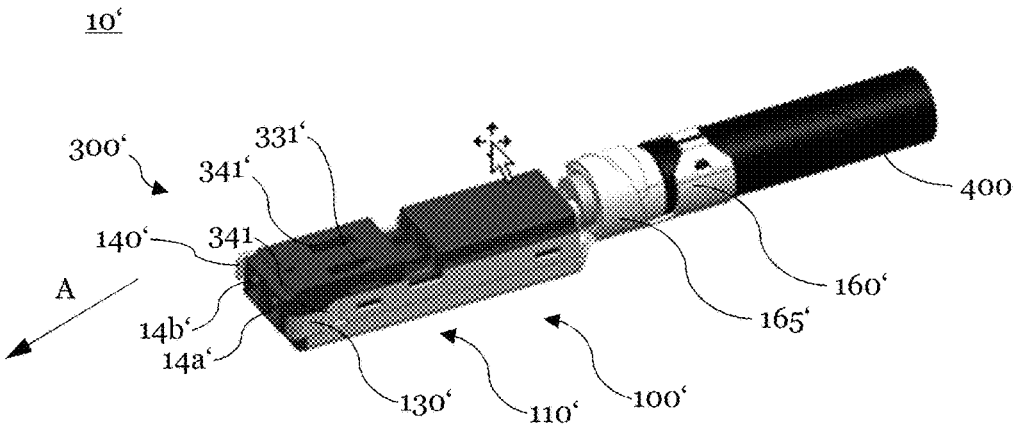
FIG. 4A is a schematic perspective view of a network connector module, according to a second embodiment.
Figure 4B:
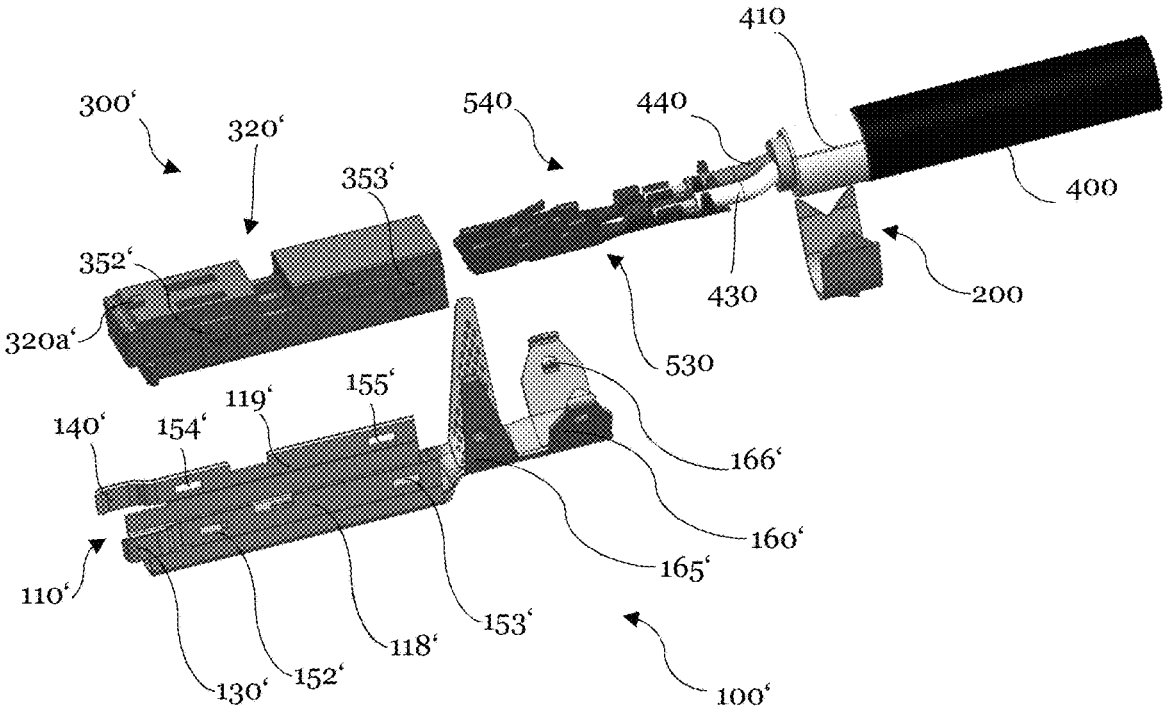
FIG. 4B is a schematic exploded view of a network connector module, as shown in FIG. 4A.

FIGS. 4A and 4B show a schematic perspective and exploded view of a network connector module 10'. The connector module 10' comprises a shielded cable 400, a U-shaped shielding member 100' and a module housing 300'. The electrical shielding 410 of the cable 400 may be electrically connected to a shielding contact means 165' of the electrical shielding member 100. The shielding contact means 165' can be crimped around the electrical shielding 410 and/or an inner ferrule 200.

Further, the electrical shielding member 100' may comprise a cable reception 160' for receiving the cable 400. The cable reception 160' may be provided with a retaining protrusion 160' that protrudes inwardly into the cable reception 160' and thereby improves the connection between the cable and the shielding member 100'. The electrical shielding member 100' has a substantially U-shaped cross section when seen from a direction opposite to the mating direction A. Further, the electrical shielding member 100' comprises contact elements 130', 140' that protrude outwardly from the receiving portion 110'. These contact elements may be provided as contact arms, each having a free end facing in mating direction A.

As the contact elements 130', 140' protrude outwardly from the receiving portion 110', the network connector module 10' can be coupled to a corresponding counter connector, so that the contacting ground contacts are not received within the receiving portion 110' of the module housing wherein the data contacts of a corresponding counter connector are at least partly received in the receiving portion 110' of the module housing. The network connector module 110' comprising outwardly protruding contact elements 130', 140' is adapted to contact respective ground contacts (G) and data contacts (S) of a corresponding counter connector having a . . . GSSGGSSG . . . contact arrangement (cf. FIG. 5A) or having a . . . GSSGSSG . . . contact arrangement (cf. FIG. 5B).

The shielding member 100' may comprise locking elements 150', 153', 154', 155', provided as locking through holes in sidewalls 118', 119' of the receiving portion. The housing 300' comprises corresponding locking elements 352', 353' that can engage (lock) with the locking elements of the shielding member 100'. Shielding member 100' surrounds the module housing 300' at least partially, wherein it covers the bottom and the sides of the module housing 300' at least partially.

Further, housing 300' may comprise a tertiary locking element 320*a*'. The tertiary locking element 320*a*' may be arranged on the housing 300' at a front portion of the network connector module 10' (i.e. adjacent to an end of the network connector module facing in mating direction A). Further, the tertiary locking element 320*a*' may protrude outwardly from housing 300'. The tertiary locking element 320*a*' may serve to lock with a secondary locking device (CPA) of the network connector and/or with a TPA (Terminal Position Assurance) member of the network connector. This allows for redundant locking of both the contact terminals 530, 540 and the network connector module with the network connector.

Figure 5A:
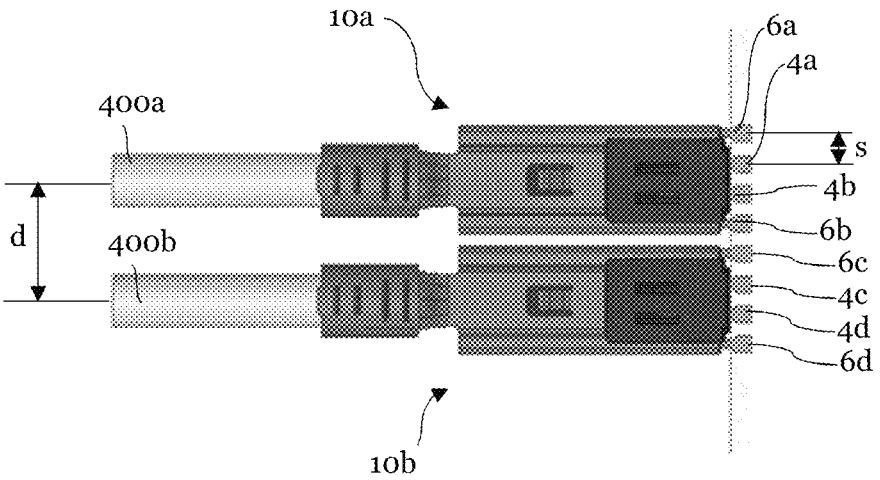
FIG. 5A is a schematic top view of two network connector modules.

FIG. 5A shows a top view of two network connector modules 10*a*, 10*b* that are coupled to ground contacts 6*a*, 6*b*, 6*c*, 6*d* and data contacts 4*a*, 4*b*, 4*c*, 4*d* of a corresponding counter connector (not shown). The ground and data contacts 6*a*, 6*b*, 6*c*, 6*d*, 4*a*, 4*b*, 4*c*, 4*d* are provided as contact pins having an angled form. Further, the ground and data contacts 6*a*, 6*b*, 6*c*, 6*d*, 4*a*, 4*b*, 4*c*, 4*d* are provided in a repeating GSSG-pattern forming a . . . GSSGGSSG contact arrangement.

The mating direction A of the angled contact pins lies within the image plane of FIG. 5A, wherein the mounting direction of these pins may be perpendicular to the image plane (not shown). The pins have a pitch s which may be about 1.5 mm, or about 1.8 mm, or about 2.0 mm. Accordingly, the cables 400*a*, 400*b* of the modules 10*a*, 10*b* may have a distance d of about four times the pitch s (d=4×s), i.e. of about 6 mm, or of about 7.2 mm, or of about 8 mm In case that angled contact pins are used as data and ground contacts, a network connector typically has a single row of network connector modules. In case that straight contact pins are used as data and ground contacts (i.e. the mounting direction lies within the plane of the mating direction A), multiple rows of network connector modules may be provided in a single network connector. A network connector may comprise in a row at least two network connector modules, preferably at least four network connectors modules and most preferably at least six network connector modules and even more preferably at least eight network connector modules.

Figure 5B:
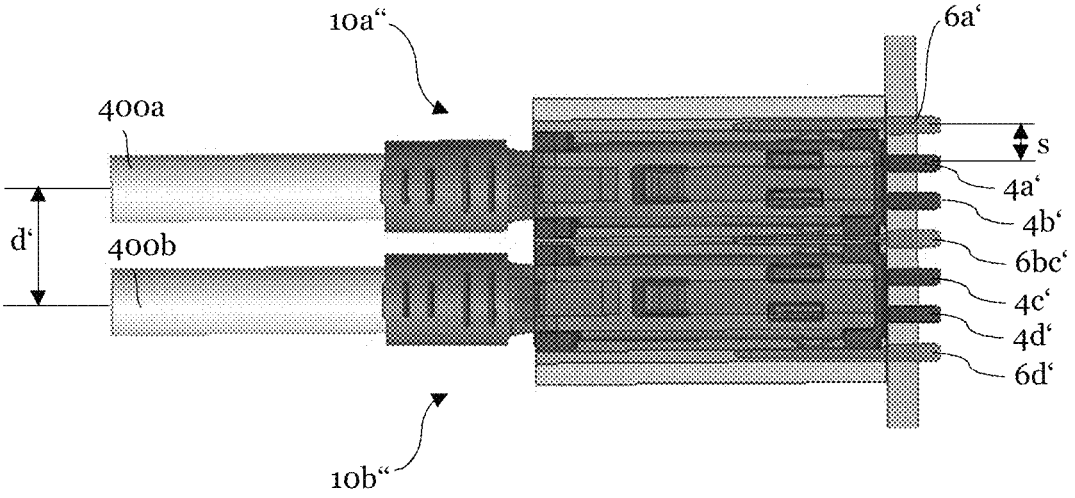
FIG. 5B is a schematic top view of two network connector modules.

FIG. 5B shows a top view of two network connector modules 10*a*", 10*b*". The network connector modules 10*a*", 10*b*" comprise contact elements that protrude outwardly from the receiving portion, so that, when the network connector module 10*a*", 10*b*" is coupled to a corresponding counter connector, the contacting ground contacts are not received within the receiving portion of the module housing and the data contacts of a corresponding counter connector are at least partly received in the receiving portion of the module housing.

The network connector modules 10*a*", 10*b*" are coupled to ground contacts 6*a*', 6*bc*', 6*d*' and data contacts 4*a*', 4*b*', 4*c*', 4*d*' of a corresponding counter connector (not shown). The ground and data contacts 6*a*', 6*bc*', 6*d*', 4*a*', 4*b*', 4*c*', 4*d*' are provided as contact pins having an angled form. Further, the ground and data contacts 6*a*, 6*b*, 6*c*, 6*d*, 4*a*, 4*b*, 4*c*, 4*d* are provided in a repeating GSSG-pattern forming a . . . GSSGSSG contact arrangement. Particularly, adjacent GSSG contact patterns of FIG. 5B share a common ground contact 6*bc*', resulting in a repeating . . . GSSGSSG . . . contact arrangement within one row.

The mating direction A of the angled contact pins lies within the image plane of FIG. 5B, wherein the mounting direction of these pins is perpendicular to the image plane (not shown). The pins have a pitch s which may be about 1.5 mm, or about 1.8 mm, or about 2.0 mm. Accordingly, the cables 400*a*, 400*b* of the modules 10*a*", 10*b*" may have a distance d' of about three times the pitch s (d'=3×s), i.e. of about 4.5 mm, or of about 5.4 mm, or of about 6 mm In case that angled contact pins are used as data and ground contacts, a network connector typically has a single row of network connector modules. In case that straight contact pins are used as data and ground contacts (i.e. the mounting direction lies within the plane of the mating direction A), multiple rows of network connector modules may be provided in a single network connector. A network connector may comprise in a row at least two network connector modules, preferably at least four network connectors modules and most preferably at least six network connector modules and even more preferably at least eight network connector modules.

Figure 6A:
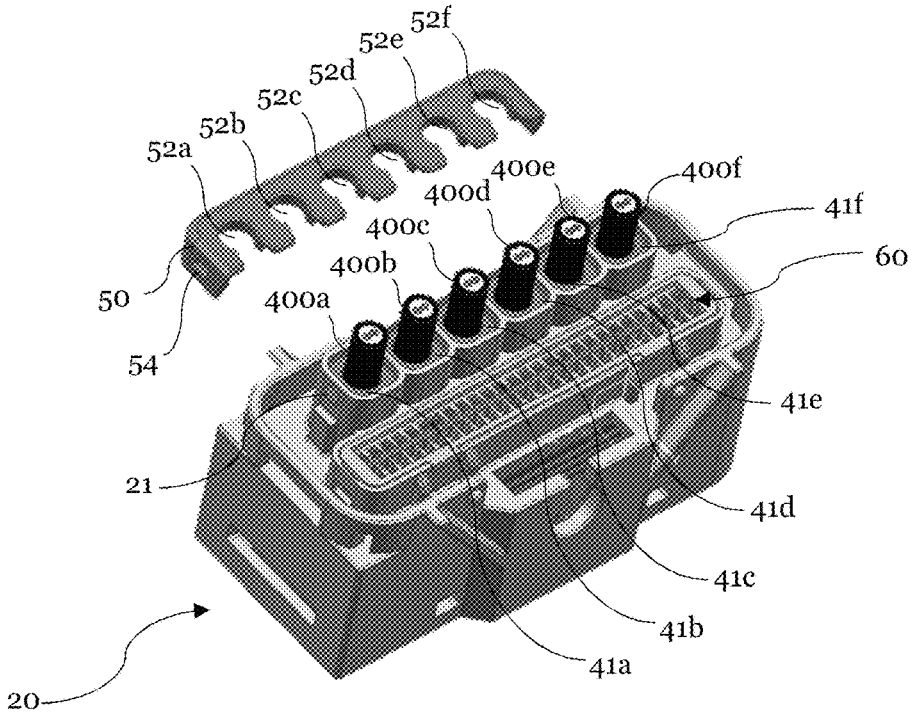
FIG. 6A is a schematic exploded view showing parts of a network connector.
Figure 6B:
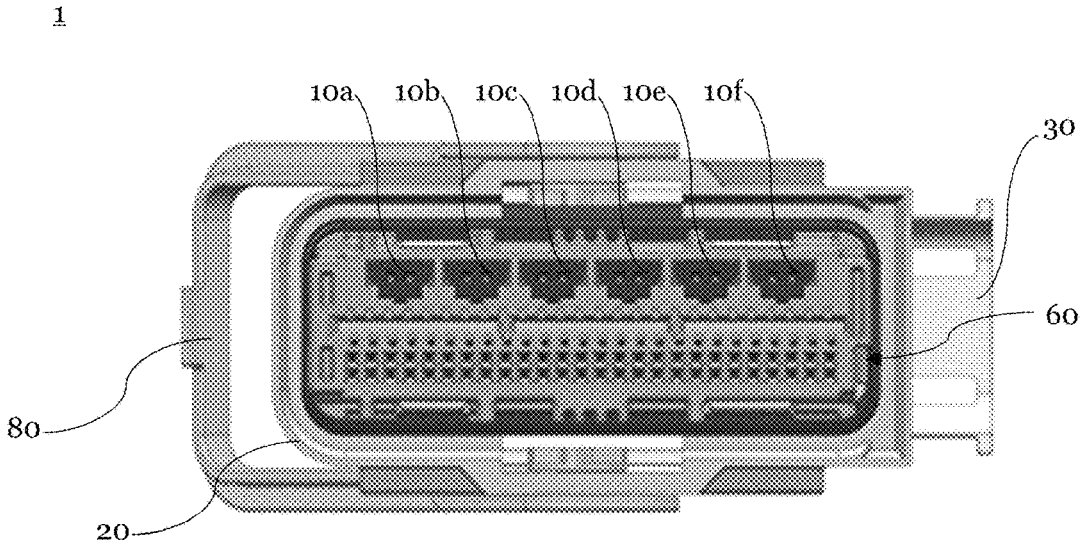
FIG. 6B is a schematic front view of a network connector.

FIG. 6A shows an exploded view of some parts of a network connector. In particular, an outer housing 20 of the network connector is shown. This outer housing 20 may receive a signal terminal 60. The signal terminal 60 may provide multiple digital signal pins for transmitting digital I/O signals. Further, the outer housing 20 may comprise a row of network connector module receptacles provided as cavities, for receiving network connector modules 10, 10'. Optionally, a network connector module seal 41*a*-41*f* may be inserted in the respective network connector module receptacle. To secure the network connector modules 10, 10' and the respective seals 41*a*-41*f* in the network connector module receptacles, a seal retaining member 50 can be provided. The seal retaining member 50 may comprise cable passages 52*a*-52*f*, being provided as cutout portions. These cable passages allow to guide the cables 400*a* to 400*f* of the respective network connector modules 10, 10'. Further, the seal retaining member 50 may comprise a locking element 54 that is adapted to be locked with a corresponding locking element 21 of the outer housing 20 of the network connector. Thus, the seal retaining member 50 may be locked with the outer housing 20 and may reliable retain the network connector modules 10, 10' in the network connector module receptacles. Alternatively, the above described network connector modules 10, 10' and 10" may be used in an unsealed network connector FIG. 6B is a schematic front view of a network connector seen in a direction against the mating direction. The network connector 1 may comprise a lever 80 for securing the network connector 1 with a corresponding counter connector (not shown). Further, the network connector 1 may comprise a secondary locking device 30 also known as CPA member. CPA-members are known in the art and prevent that the connector becomes lose and/or that an electrical contact is interrupted during use of the connector.

Further, as shown in the front view, the network connector 1 comprises a signal terminal 60 having multiple signal pins for transmitting digital I/O signals. In a top row, there are six network connector modules 10*a* to 10*f* provided.

Figure 7:
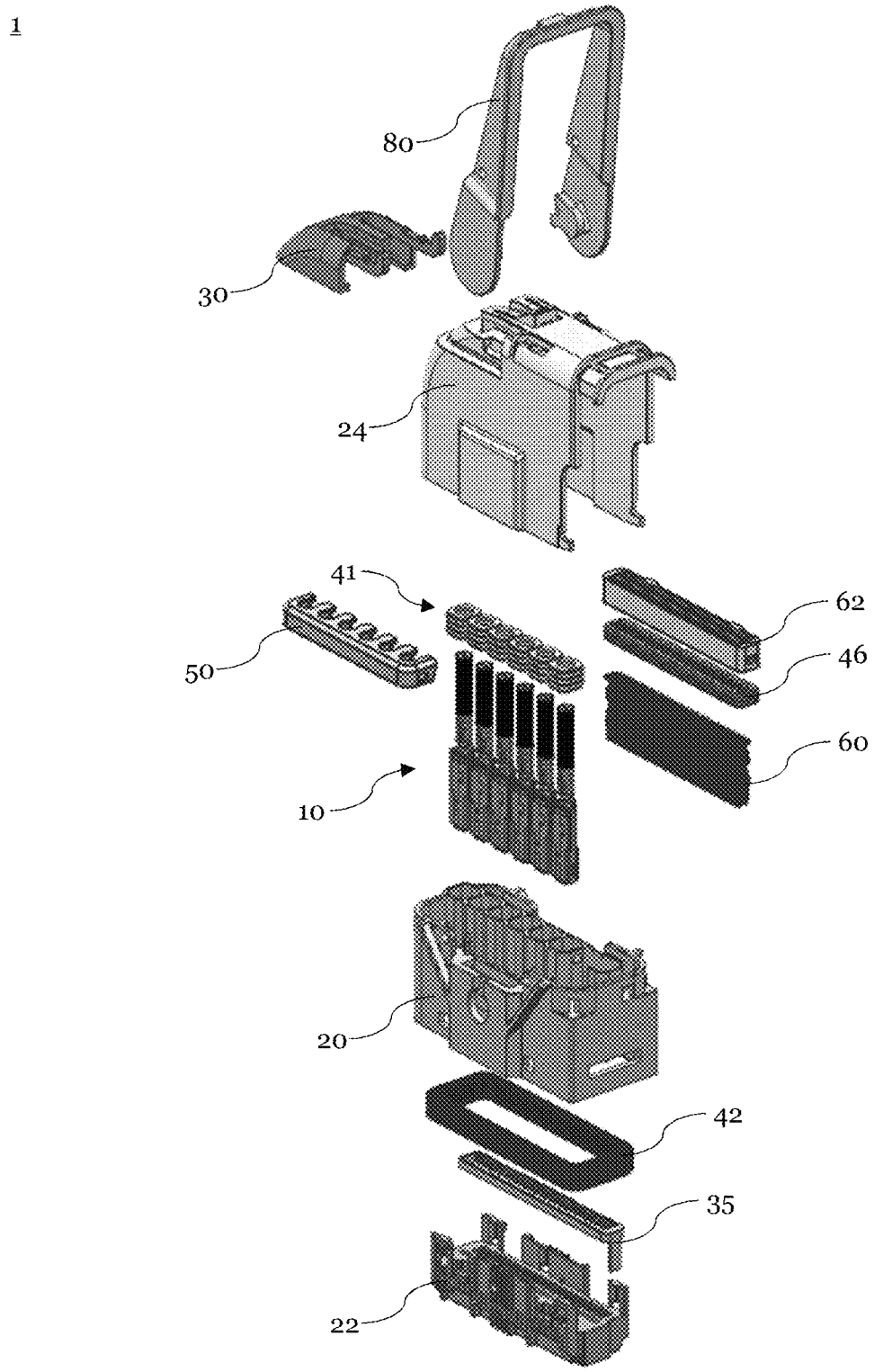
FIG. 7 is a schematic exploded view of a network connector.

FIG. 7 shows an exploded view of an example network connector. The network connector shown, comprises six network connector modules 10, an outer housing 20 and an inner housing 22. The inner housing can be sealed by means of a seal 42 to the outer housing 20. Further, the network connector modules may be received in the outer housing and may be sealed with seals 41. A seal retaining member 50 retains the network connector modules 10 and the seals 41 within the outer housing 20. The outer housing 20 may be covered with a cover 24. Further, the network connector 1 may comprise a secondary locking device 30, also referenced as connector position assurance member (CPA). The secondary locking device 30 provides an additional lock and prevents the network connector from being unplugged unintentionally. Further, a lever 80 is provided that allows a secure fixation of the network connector 1 with the corresponding counter connector 2. Further, the network connector 1 may comprise a signal terminal 60 that may be sealed with a terminal mat seal 46. A rear grid 62 may be provided for providing a defined grid of the pins of terminal 60.

Figure 8:
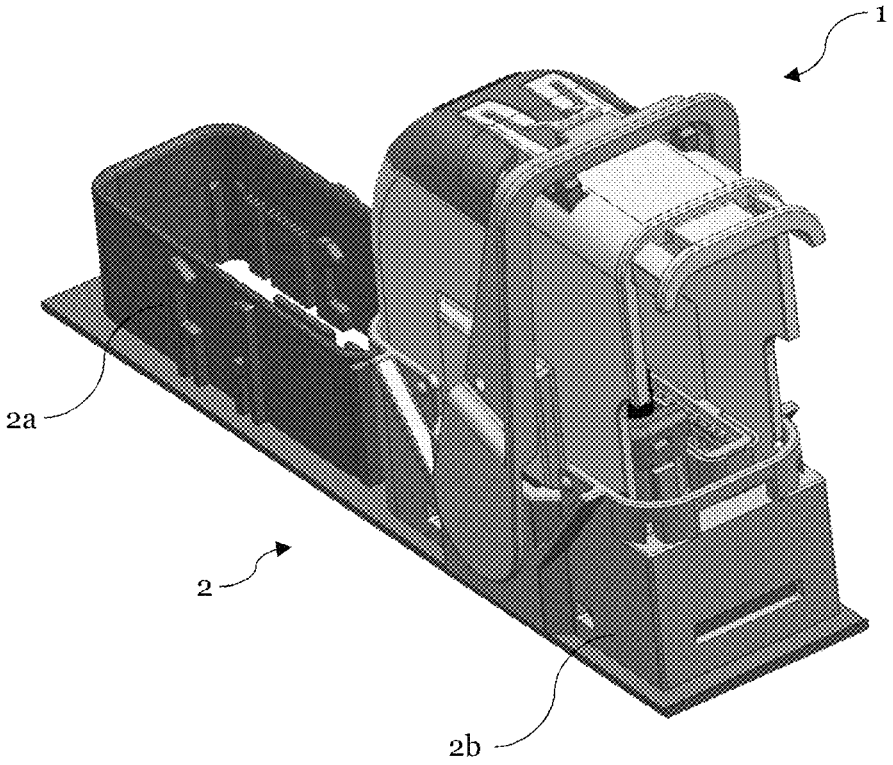
FIG. 8 is a schematic perspective view of a network connector being plugged to a corresponding counter connector.

FIG. 8 shows a perspective view of a network connector 1 being plugged to a corresponding counter connector 2. The corresponding counter connector 2 comprises two network connector receptacles 2*a*, 2*b*, wherein the network connector 1 is plugged to the network connector receptacle 2*b*. The corresponding counter connector 2 may also comprise a single network connector receptacle or multiple network connector receptacles. With the network connector and/or the network connector module, network communication with data rats of at least up to 1 Gbit/s can be achieved.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

The invention claimed is:

1. A network connector module for a network connector adapted for network communication with data rates of at least up to 1 Gbit/s, the network connector module comprising:

a cable that includes a shielding and at least two wires;

at least two electrical contact terminals for electrically contacting data contacts of a corresponding counter connector, each of the electrical contact terminals being electrically connected to a respective one of the wires of the cable;

a module housing made of electrically insulating material, the module housing comprising at least two terminal receptacles that are arranged directly adjacent to each other, each of the terminal receptacles receives one of the electrical contact terminals;

an electrical shielding member made of cut and bent sheet metal, wherein the electrical shielding member is in electrical contact with the shielding of the cable, the electrical shielding member at least partially surrounds the module housing, the electrical shielding member includes at least two contact elements for electrically contacting ground contacts of the corresponding counter connector, the contact elements being arranged lateral of the module housing so as to be in a row with the electrical contact terminals received in the module housing, and wherein the contact elements sandwich the electrical contact terminals; and the electrical shielding member has a substantially rectangular cross section formed by a bottom wall, a top wall and two sidewalls, the top wall includes a cutout portion providing a receiving portion at a terminal end of the electrical shielding member, the cutout portion forming opposing guiding shoulders for linearly guiding the module housing during insertion of the module housing into the receiving portion, the module housing protruding through the top wall at the receiving portion with the network connector module assembled.

2. The network connector module of claim 1, wherein the contact elements protrude inwardly in the receiving portion, so that, when the network connector module is coupled to a corresponding counter connector, the contacting ground contacts and the data contacts of the corresponding counter connector are at least partly received in the receiving portion of the module housing.

3. The network connector module of claim 2, wherein the electrical shielding member has an inner height measured from the bottom wall to the top wall of the electrical shielding member in the range of 2.5 mm to 3.3 mm.

4. The network connector module of claim 1, wherein the electrical shielding member comprises a receiving portion for receiving the module housing;

the receiving portion is substantially U-shaped; and the contact elements protrude outwardly from the receiving portion, so that, when the network connector module is coupled to the corresponding counter connector, the contacting ground contacts are not received in the receiving portion of the module housing.

5. The network connector module of claim 1, wherein the contact elements are embossed elements that are integrally formed with a respective side wall of the receiving portion.

6. The network connector module of claim 1, wherein the contact elements are contact arms that have a free end, and the free end faces in a mating direction.

7. The network connector module of claim 1, wherein at least one of the electrical shielding member and the module housing includes a latching element for latching with a network connector.

8. The network connector module of claim 1, wherein the contact elements and the electrical contact terminals are arranged so as to be adapted to electrically contact ground contacts and data contacts of the corresponding counter connector that have an equidistant pitch in a row direction, wherein the pitch is about 1.8 mm.

9. A network connector assembly capable of communicating at data rates of at least up to 1 Gbit/s, the network connector assembly comprising:

a network connector housing, and at least two network connector modules according to claim 1, wherein the network connector housing comprises network connector module receptacles, for receiving the at least two network connector modules, and the network connector assembly includes:

at least two network connector module seals that are received in the network connector module receptacles, and a seal retaining member that is adapted to be coupled to the network connector housing and to retain the network connector modules and the network connector module seals within the network connector module receptacles.

10. A method of assembling a network connector assembly according to claim 9, the method comprising:

inserting each network connector module in a respective network connector module receptacle of the network connector housing, and latching the network connector module with the network connector housing.

11. A method of assembling a network connector module according to claim 1, the method comprising:

inserting the module housing in the receiving portion of the electrical shielding member, and locking the module housing with the electrical shielding member.

12. The network connector module of claim 1, wherein the contact elements protrude outwardly from the receiving portion, so that, when the network connector module is coupled to the corresponding counter connector, the contacting ground contacts are not received within the receiving portion of the module housing and the data contacts of the corresponding counter connector are at least partly received in the receiving portion of the module housing.

13. The network connector module of claim 1, wherein each of the electrical contact terminals include a primary locking element removably received in a corresponding through opening in the module housing for locking electrical contact terminals to the module housing the electrical shielding member leaving the primary locking elements exposed via the through openings with the network connector module assembled.

14. A network connector module for a network connector adapted for network communication with data rates of at least up to 1 Gbit/s, the network connector module comprising:

a cable that includes a shielding and at least two wires;

at least two electrical contact terminals for electrically contacting data contacts of a corresponding counter connector, each of the electrical contact terminals being electrically connected to a respective one of the wires of the cable;

a module housing made of electrically insulating material, the module housing comprising at least two terminal receptacles that are arranged directly adjacent to each other, each of the terminal receptacles receives one of the electrical contact terminals;

an electrical shielding member made of cut and bent sheet metal, wherein the electrical shielding member is in electrical contact with the shielding of the cable, the electrical shielding member at least partially surrounds the module housing, the electrical shielding member includes at least two contact elements for electrically contacting ground contacts of the corresponding counter connector, the contact elements being arranged lateral of the module housing so as to be in a row with the electrical contact terminals received in the module housing, and wherein the contact elements sandwich the electrical contact terminals, wherein the electrical shielding member comprises at least one locking element that is adapted to engage with a corresponding locking element of the module housing for locking the module housing with the electrical shielding member, the electrical shielding member has a substantially C-shaped cross section formed by a bottom wall and two sidewalls providing a receiving portion for the module housing on an open side extending an entire longitudinal length of the electrical shielding member opposite the bottom wall.

15. The network connector module of claim 14, wherein at least one locking element is a latching arm provided on a rearward portion of the electrical shielding member at a bottom wall of the electrical shielding member.

16. The network connector module of claim 14, wherein at least one locking element is a through opening provided in a side wall of the receiving portion of the electrical shielding member.

* * * * *